US011117175B2

(12) United States Patent
Aigner et al.

(10) Patent No.: US 11,117,175 B2
(45) Date of Patent: Sep. 14, 2021

(54) BENDING PRESS AND BENDING METHOD

(71) Applicant: TRUMPF Maschinen Austria GmbH & Co. KG, Pasching (AT)

(72) Inventors: Wolfgang Aigner, Sattledt (AT); Stefano Speziali, Foligno (IT); Thomas Weiss, Linz (AT)

(73) Assignee: TRUMPF MASCHINEN AUSTRIA GMBH & CO. KG, Pasching (AT)

( * ) Notice: Subject to any disclaimer, the term of this patent is extended or adjusted under 35 U.S.C. 154(b) by 269 days.

(21) Appl. No.: 16/397,715

(22) Filed: Apr. 29, 2019

(65) Prior Publication Data

US 2019/0247905 A1 Aug. 15, 2019

Related U.S. Application Data

(62) Division of application No. 15/026,632, filed as application No. PCT/AT2014/050232 on Oct. 2, 2014, now Pat. No. 10,350,662.

(30) Foreign Application Priority Data

Oct. 4, 2013 (AT) ..... A 50645/2013

(51) Int. Cl.
*B21D 5/04* (2006.01)
*B21D 5/00* (2006.01)

(52) U.S. Cl.
CPC ..... *B21D 5/04* (2013.01); *B21D 5/002* (2013.01)

(58) Field of Classification Search
CPC ..... B21D 5/002; B21D 5/04; B21D 5/045; B21D 5/047
(Continued)

(56) References Cited

U.S. PATENT DOCUMENTS 4,722,214 A * 2/1988 Hayashi ..... B21D 5/04 72/319
4,856,315 A 8/1989 Salvagnini
(Continued)

FOREIGN PATENT DOCUMENTS

DE 196 39 590 A1 4/1998
EP 0 274 159 A2 7/1988
(Continued)

OTHER PUBLICATIONS

International Search Report of PCT/AT2014/050232, dated Feb. 5, 2015.

*Primary Examiner* — Shelley M Self
*Assistant Examiner* — Jared O Brown
(74) *Attorney, Agent, or Firm* — Collard & Roe, P.C.

(57) ABSTRACT

A forming operation on a workpiece clamps the workpiece between a first clamping jaw with a first shaping edge, and an adjustable second clamping jaw with a second shaping edge so that a portion projects between the shaping edges and afterwards a bending edge of an adjustable bending bar is guided at a distance past the shaping edges, whereby the portion of the workpiece is angled away in relation to the part of the workpiece that is clamped between the clamping jaws. The bending edge is guided on angling along a straight path of movement of the bending edge, and after the bending edge has passed the shaping edges, the shaping edges are adjusted along an adjustment path which approaches the path of movement of the bending edge.

12 Claims, 5 Drawing Sheets

(58) Field of Classification Search
USPC ..... 72/311, 319, 320, 322, 323
See application file for complete search history.

(56) References Cited

U.S. PATENT DOCUMENTS

| | | | | | |
|---|---|---|---|---|---|
| 5,182,936 | A * | 2/1993 | Sartorio | B21D 5/0281 | 72/420 |
| 5,313,814 | A | 5/1994 | Yamamoto et al. | | |
| 5,615,571 | A * | 4/1997 | Courant | H05K 13/0092 | 72/322 |
| 5,642,291 | A * | 6/1997 | Prunotto | B25J 9/1671 | 72/422 |
| 5,868,024 | A * | 2/1999 | Codatto | B21D 5/04 | 72/323 |
| 5,941,116 | A * | 8/1999 | Kunze | B21D 5/04 | 72/306 |
| 5,950,484 | A | 9/1999 | Kutschker | | |
| 6,196,041 | B1 | 3/2001 | Codatto | | |
| 7,055,355 | B2 | 6/2006 | Codatto | | |
| 8,820,134 | B2 | 9/2014 | Cabianca | | |
| 2008/0072648 | A1 | 3/2008 | Kutschker | | |
| 2012/0318031 | A1* | 12/2012 | Borwig | F16L 9/17 | 72/306 |

FOREIGN PATENT DOCUMENTS

| | | | | |
|---|---|---|---|---|
| EP | 1 797 973 | A1 | 6/2007 | |
| EP | 1797973 | A1 * | 6/2007 | B21D 5/0209 |
| EP | 1 905 522 | A1 | 4/2008 | |
| FR | 2 584 633 | A1 | 1/1987 | |
| JP | 2000-176550 | A | 6/2000 | |
| KR | 101420048 | B1 * | 7/2014 | B21D 5/0209 |

* cited by examiner

BENDING PRESS AND BENDING METHOD

CROSS REFERENCE TO RELATED APPLICATIONS

This application is a divisional of and Applicant claims priority under 35 U.S.C. §§ 120 and 121 of U.S. application Ser. No. 15/026,632 filed on Jun. 3, 2016, which application is a national stage application under 35 U.S.C. § 371 of PCT Application No. PCT/AT2014/050232 filed on Oct. 2, 2014, which claims priority under 35 U.S.C. § 119 from Austrian Application No. A 50645/2013 filed on Oct. 4, 2013, the disclosures of each of which are hereby incorporated by reference. A certified copy of priority Austrian Application No. A 50645/2013 is contained in parent U.S. application Ser. No. 15/026,632.

BACKGROUND OF THE INVENTION

1. Field of the Invention

The invention relates to a bending press and a method for shaping a workpiece.

2. Description of the Related Art

The so-called swivel bending method and swivel bending presses known for this purpose have been in use for a long time, in particular for the manufacture of sheet metal housings or sheet metal profiles, and have been known as the prior art for a long time.

An important factor here is to be able to produce shaping angles of more than 90° on the workpiece, so that even after an unavoidable springing back of a workpiece when relieving the load bending angles of at least 90° can be achieved.

This requires that a bending edge arranged on the bending bar of a swivel bending press in a first step is moved past at a distance on clamping jaws or holding-down devices, which hold the workpiece, and then in a second step is moved transversely in the direction of the holding-down device in order to achieve on the workpiece a shaping angle that is greater than 90°. As this is not possible with a simple straight guiding of the bending bar, swivel bending machines have expensive and complicated guides and drives in order to perform such combined movements of the bending bar. This complexity of the bending bar drive also often restricts the possible bending arm lengths and the processable workpiece thickness.

SUMMARY OF THE INVENTION

The objective of the invention is to provide a bending press which has the advantages of the known swivel bending method, but has a simple structure and only has the known restrictions to a lesser extent.

The objective of the invention is achieved by a generic bending press in which the bending bar guide is designed as a linear guide and performs a straight movement path of the bending edge and the shaping edges of both clamping jaws can be adjusted by means of a transverse guide of the clamping beams and an adjusting drive along an adjustment paths, which approaches the movement path of the bending edge. This relative movement of the clamping beam transversely to the movement path of the bending bar can be performed at a right angle or obliquely to the movement path of the bending bar. In the case of such a bending press the complicated movement of the bending bar of a swivel bending press relative to the fixed clamping jaws, which hold the workpiece, is replaced by a combination of simple movements of the bending bar and the clamping jaw. The fact that the workpiece in this case has to move along with the clamping jaws is less obvious as a disadvantage than the thereby achieved advantages. The transverse guiding of the clamping jaws or the clamping beams supporting the latter can be designed to be structurally very simple, as well as the straight guide of the bending bar.

The straight guiding of the bending bar is preferably oriented in vertical direction, however embodiments are also possible in which the straight guiding runs obliquely to the vertical direction or also horizontally.

The guiding of the clamping beam need not necessarily be in a straight line but can also cause a movement in the form of a curve, which approaches the straight movement path of the bending bar. For example the clamping beam can be moved along a part of a circular path.

An embodiment with little additional effort for the parallel adjustability of the two clamping beams is obtained when the transverse guide comprises the clamping beam guide of the second clamping beam and a structurally separate clamping beam guide of the first clamping beam, wherein the adjustment paths of the clamping beams run parallel to one another. As a clamping beam guide and a clamping beam drive are already necessary for performing the clamping process, the latter can be used advantageously in a special embodiment for the purposes of transverse guiding. The clamping beam guide of the first clamping beam can be designed to be structurally simply the same as the clamping beam guide of the second clamping beam.

An embodiment which requires only small adjusting forces for the transverse adjustment is obtained if the clamping beam guides are designed as mutually parallel straight guides and run at an inclination angle, in particular between 10° and 30°, to the bending bar guide. In the absence of frictional effects at an inclination angle of 30° there is force component for the transverse adjustment relative to the adjusting force in the direction of the clamping jaw guide.

In an alternative structural form of the bending press the transverse guide of the clamping beam runs slightly at a right angle to the bending bar guide. In this way there is clear separation of the clamping beam guide and clamping beam drive on the one hand the transverse guide with adjusting drive on the other hand. The respective guides and drive can be configured optimally in this way to meet the respective re-requirements. The transverse guide and the adjusting drive require in contrast to the clamping beam only a small working path, which is why very different structural solutions can be selected, such as e.g. linear guides, eccentric guides etc.

A stable synchronization of the movement of the two clamping beams is achieved when the clamping beam guides are arranged on a clamping beam frame which relative to the machine frame by means of the transverse guide and the adjusting drive is adjustable perpendicular, i.e. at a right angle to or obliquely to the movement path of the bending edge. Any differences in the movements of the clamping beams by two separate drives acting on the clamping beam frame can be avoided in this way, if to adjust the clamping beam frame a common central adjusting drive is provided.

An assembly friendly embodiment of a bending press is achieved when the bending bar guide is arranged on a first frame part, in particular an O-frame, and the clamping beam guide and the transverse guide are arranged on a second frame part, in particular an O-frame, spaced apart from the latter. The two O-frames are connected together by suitable side stands.

A slim and material-saving embodiment of a bending press is provided when the bending bar guide and the clamping jaw guide and the transverse guide are arranged on opposite outer sides of a central frame part, in particular an O-frame. The flow of force between the bending bar and clamping beam is performed in this case over a short path directly over the central frame part.

In order to be able to perform both positive bending and also negative bending in an opposite direction without turning the workpiece, it is an advantage if on the machine frame two bending bars adjustable in opposite direction are arranged for bending in opposite directions.

As always only one bending bar is used, it is also possible to provide two spaced apart bending bars oriented in opposite directions on a common bar frame, in particular an O-frame, and the latter can be adjusted by means of the bending bar guide in a straight line. The joint bar frame has a high degree of resistance to deformation can be guided very precisely which provides an increased bending precision.

To facilitate the adjustment of the bending parameters to the respective bending task, in particular to the thickness of a workpiece it is an advantage if a horizontal distance between the clamping beam and bending bar is adjustable. In particular, with thick workpieces the bending process can be initiated at an increased distance and thus with a longer lever arm, e.g. at least three times the material thickness of the workpiece, whereby the bending drive can be protected or can be designed to be smaller.

The flexible use of a bending press is increased considerably if the shaping edges on the clamping jaws and/or the bending edge on the bending bar are composed of tool segments in the form of bending tools and clamping tools and thereby in a simple manner different lengths can be achieved for the bending edge or the shaping edges. The fitting processes required for this can also be performed automatically, e.g. by means of spindles for moving tools.

In order to also supply large dimensioned workpieces easily to the bending press and to remove bent workpieces simply from the bending press it is an advantage if in the machine frame between the clamping beam and the bending bar or bars a free through opening is formed for a workpiece. In this way to a certain extent it possible to bend in passing, as workpieces no longer have to be taken out on the feeding side.

The objective of the invention is also achieved by a method for shaping a workpiece, in which the latter is clamped between a first clamping jaw with a first shaping edge and a second clamping jaw with a second shaping edge so that a portion projects between the shaping edges and then a bending edge of an adjustable bending bar is guided past the shaping edges at a distance, whereby the portion is angled relative to the part of the workpiece clamped between the clamping jaws. According to the invention the bending edge is guided on angling along a straight movement path and after the bending edge has passed the shaping edges adjusts the latter along an adjustment path, which approaches the movement path of the bending edge.

According to a simply executed variant of the method once the bending edge has passed the shaping edges, the adjusting movement of the bending edge is largely or completely stopped and at the same time or immediately afterwards the shaping edges are guided at a right angle perpendicularly on or over the movement path of the bending edge. In this case the lower clamping jaw or the lower clamping beam does need adjusting in vertical direction and a vertical adjustment of the workpiece is not necessary during the shaping process.

According to an alternative embodiment of the method it is possible that after the bending edge has passed the shaping edges, the shaping edges are guided at an inclination angle perpendicularly on or over the movement path of the bending edge and the adjusting movement of the bending edge coupled with the movement of the shaping edges is continued up to the completion of the shaping process. The transverse guiding of the clamping beams can be provided in this case solely by two parallel clamping beam guides.

BRIEF DESCRIPTION OF THE DRAWINGS

For a better understanding of the invention the latter is explained in more detail with reference to the following Figures.

In a much simplified, schematic representation.

DETAILED DESCRIPTION OF PREFERRED EMBODIMENTS

Figure 1:
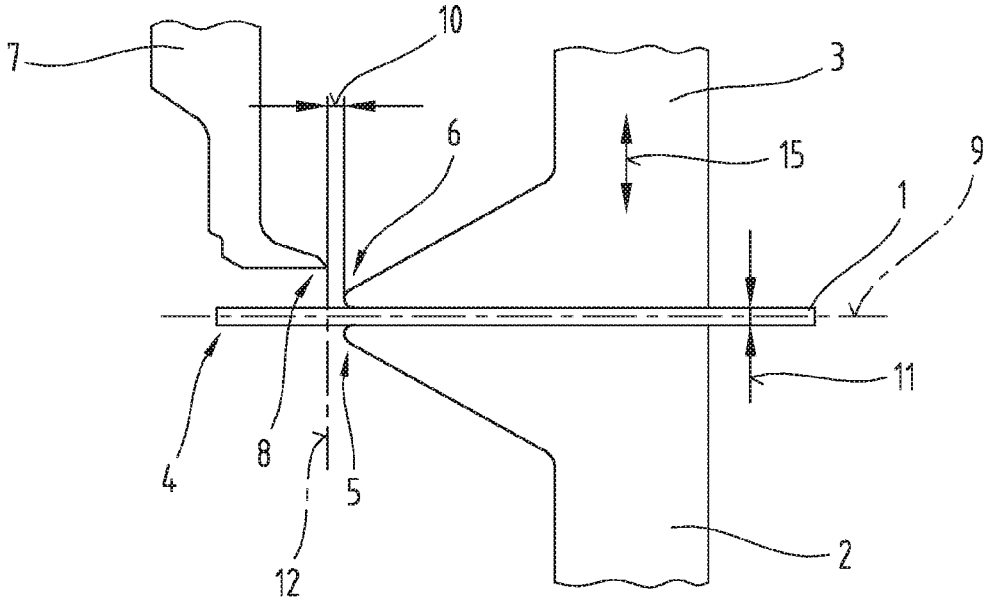
FIG. 1 shows the method for shaping a workpiece prior to beginning the shaping process.
Figure 2:
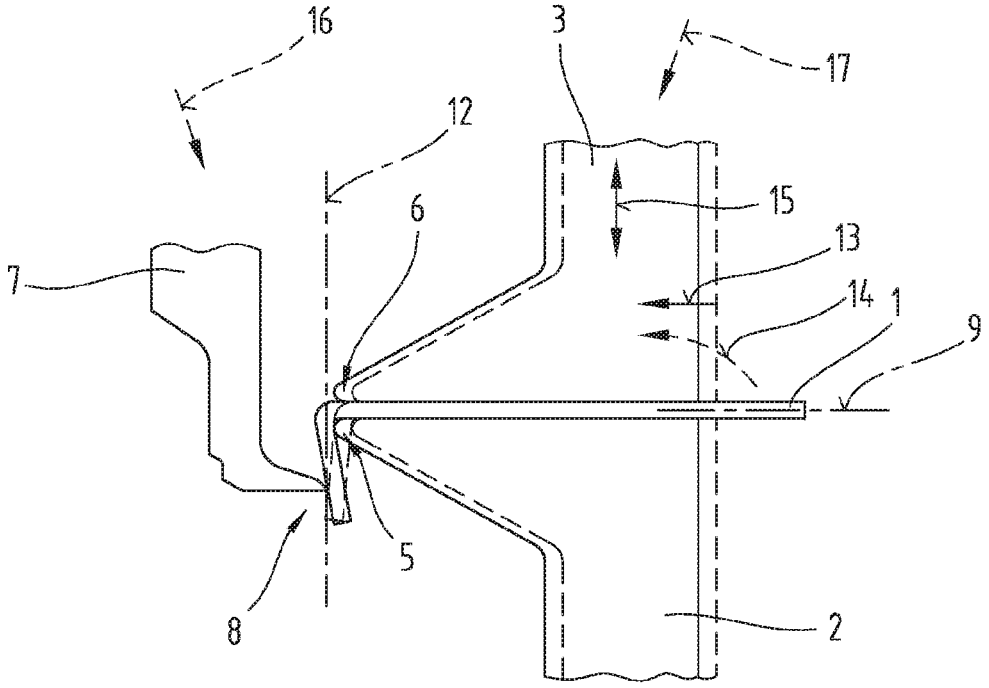
FIG. 2 shows the method for shaping a workpiece at the end of the shaping process.

FIGS. 1 and 2 show the method according to the invention for shaping a workpiece 1, wherein FIG. 1 shows the state prior to beginning the shaping process and FIG. 2 the state at the end of the shaping process. This is a special embodiment of the shaping method known as swivel bending.

In this case the workpiece 1 is clamped between a first clamping jaw 2 and a second clamping jaw 3, so that a portion 4 can be angled in a subsequent shaping process relative to the rest of the workpiece 1. The workpiece 1 consists of an at least partly planar material, which is suitable for bending shaping. On the clamping jaw 2 a shaping edge 5 is formed which is effective when the portion 4 is angled downwards, and on the second clamping jaw 3 a second shaping edge 6 is formed which is effective if the portion 4 is angled upwards. In the shown embodiment the clamping jaws 2, 3 have a shoe-like cross-section, whereby a workpiece 1 can be bent over the shaping edges 5, 6 beyond a right angle. The angling of the portion 4 is performed by means of a bending bar 7, which has a bending edge 8. FIGS. 1 and 2 show a bending bar 7 with a bending edge 8 which is provided for angling the portion 4 downwards.

The shaping edges 5, 6 are provided with a radius which also influences the smallest possible inner radius of the bent workpieces at the shaping point.

During the shaping process the bending bar 7 is moved downwards approximately at a right angle to a horizontal workpiece plane 9, the bending edge 8 having a horizontal distance 10 from the shaping edges 5, 6.

The distance 10 is selected to be at least as large as a workpiece thickness 11 and is preferably 1.5 times to 8 times the workpiece thickness 11. In particular with thick workpieces 1 a larger distance 10 can facilitate the introduction of the shaping process by means of a better levering effect.

In the shaping method according to the invention the bending edge 8 is guided along a straight movement path 12, even after it has passed the two shaping edges 5 and 6 and thereby the portion 4 is moved into an angled position. With fixed clamping jaws 2, 3 with such a straight movement path 12 of the bending edge 8 the portion 4 can be angled by a maximum of up to 90°, if a distance 10 is selected which corresponds approximately to the workpiece thickness 11, by an unavoidable springing back after distancing the bending edge 8 in this way with the straight movement of the bending edge 8 only a shaping angle of less than 90° can be achieved. In the shaping methods known from the prior art therefore the bending bar 7 with the bending edge 8 is moved after passing the shaping edges 5, 6 differently from the straight movement path 12 with a movement component parallel to the workpiece plane 9 on the clamping jaws 2, 3, whereby the portion 4 can be shaped beyond a shaping angle of 90°. This requires that the guiding of the bending bar 7 has to allow movement in both vertical direction and horizontal direction.

In contrast to this method known from the prior art with the method according to the invention the bending edge 8 stays even after passing the shaping edge 5, 6 on its straight movement path 12, and an angling of the portion 4 beyond 90° means that the shaping edges 5, 6 of both clamping jaws 2, 3 together with the clamped workpiece 1 are adjusted along an adjustment path 13 which approaches the movement path 12 of the bending edge 8 and is indicated in FIG. 2 by an arrow.

Whereas in the known shaping method of the swivel bending the bending bar 7 has to perform a comparatively complicated movement, in order to achieve an angled movement of the bending edge relative to the shaping edges 5, 6, the method according to the invention is simplified in that the bending bar 7 and the clamping jaws 2, 3 only have to cover straight movement paths, whereby the guides required for this have a structurally simple design.

The workpiece 1 angled downwards by the bending edge 8 prior to the transverse movement of the clamping edges 5, 6 is indicated in Fig. by dashed lines. The following reduction in the distance 10 between the clamping jaws 2, 3 and the bending bar 7 or the shaping edges 5, 6 and the bending edge 8 after passing the shaping edges 5, 6 is achieved accordingly from a relative movement running transversely to the straight movement path 12 between the clamping jaws 2, 3 and the bending bar 7. It is possible in this case that with this relative movement the bending bar 7 is in a stationary position and only the clamping jaws 2, 3 with the clamped workpiece 1 are moved, however it is also possible that the straight movement of the bending edge 8 is continued along the movement path 12 and at the same time the clamping jaws 2, 3 are adjusted along an adjustment path running transversely to the movement path 12, wherein a right-angled or oblique relative movement is performed between the bending bar 7 and clamping jaws 2, 3. The adjustment path 13 of the clamping jaws 2, 3 is thus oriented not necessarily at a right angle to the movement path 12 of the bending edge 8, but can also run obliquely to the latter along a straight line or also along a curved path running obliquely to the movement path 12, for example a circular path. FIG. 2 shows with a dashed arrow such a curved adjustment path 14, which can be produced for example by means of an eccentric bearing of the clamping jaws 2, 3 or the machine parts supporting the latter.

FIGS. 1 and 2 also show with a double arrow the clamping movement 15 of the clamping jaw 3 relative to the clamping jaw 2. An alternative embodiment of the method is also indicated in FIG. 2, in which the bending bar 7 is moved along a movement path 16 different from the vertical direction but indicated straight by a dashed arrow and the clamping jaws 2, 3 together with the clamped workpiece 1 follow an oblique adjustment path 17 relative to the vertical direction. The adjusting movements of the bending bars 7 and the clamping jaws 2, 3 can thus be coupled by a control device so that a relative movement is performed which is optimal for the shaping process.

Figure 3:
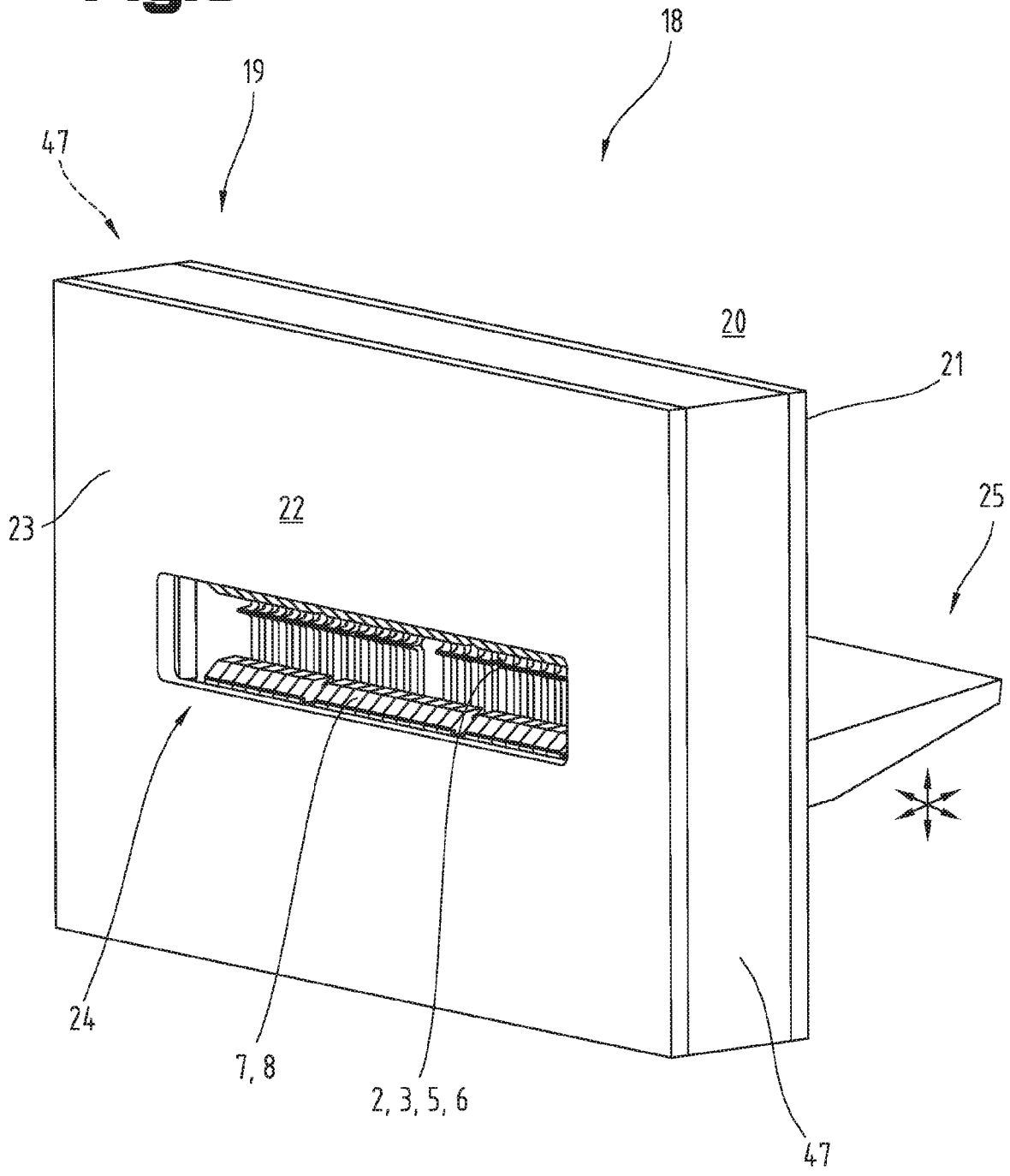
FIG. 3 shows a view of a possible embodiment of a bending press according to the invention.

FIG. 3 shows a rear view of a bending press 18 according to the invention by means of which the shaping method can be performed described with reference to FIGS. 1 and 2.

The bending press 18 comprises a machine frame 19, in which the adjustable bending bar already described by FIGS. 1 and 2 and the two clamping beams supporting the clamping jaws 2, 3 can be mounted adjustably. The shown machine frame 19 comprises on its front side 20 a plate-like O-frame 21 and on its rear side 22 also a plate-like O-frame 23. The recesses in the O-frame 21 and 23 form a through opening 24, which extends through the bending press 18 and enables the feeding of a workpiece 1 to the clamping beam or the bending bar 7 and for example also enables the removal of the bent workpiece on the rear side 22.

On the front side 20 of the bending press 18 in the shown embodiment a support device 25 is arranged which can support the part of a workpiece 1 located outside the bending press 18 and optionally also in addition performs the movements executed by the clamping jaws 2, 3 with the clamped workpiece 1 synchronously in order to avoid unwanted workpiece deformations. This adjustability of the support device 25 is indicted in FIG. 3 by double arrows in the main coordinate directions.

The machine frame 19 also comprises side stands, which in the shown embodiment connect the two O-frames 21, 23. Intermediate spaces between supporting components of the machine frame 19 can be closed by covers, whereby a largely closed machine exterior is provided.

Figure 4:
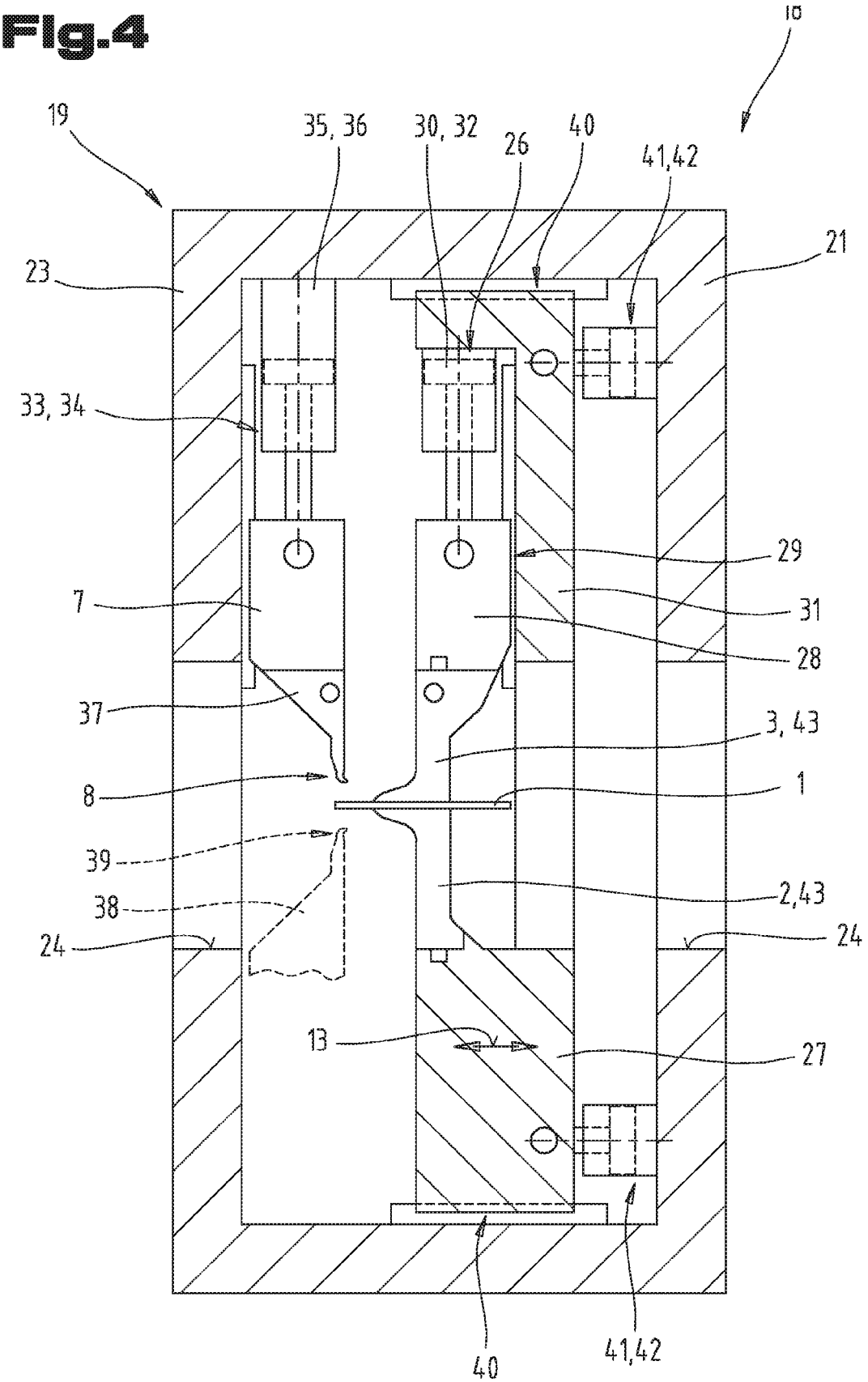
FIG. 4 shows a cross-sectional view of a possible embodiment of a bending press.

FIG. 4 shows a cross section of a further embodiment of a bending press 18, by means of which a workpiece 1 can be angled.

A workpiece 1 can be inserted through a through opening 24 in the machine frame 19 into the inside of the bending press 18, where it is held for performing the shaping process by means of a clamping device 26. The clamping device 26 comprises a first clamping beam 27 which supports the first clamping jaw 2 and a second clamping beam 28 which supports the second clamping jaw 3. The second clamping beam 28 can be adjusted by means of a clamping beam guide 29 and a clamping beam drive 30 relative to the first clamping beam 27. The first lower clamping beam 27 is widened in this embodiment to an O-frame 31 which extends into the upper half of the bending press 21 and supports the fixed part of the clamping beam guide 29. The latter comprises for example a linear guide rail, by means of which the upper second clamping beam 28 is guided in vertical direction in the machine frame 19. The clamping beam drive 30 is formed in the shown embodiment by a hydraulic cylinder 32, but can also be designed as a spindle drive with an electric motor.

The adjustable bending bar 7 is mounted adjustably by means of a bending bar guide 33 in the form of a linear guide 34 on the machine frame 19 and is driven by a bending bar drive 35, here in the form of a hydraulic cylinder 36. The bending edge 8 at the lower end of the bending bar describes a straight movement path 12 (see FIG. 1, 2), which in the shown embodiment runs in vertical direction. By means of an oblique bending bar guide 33 a different movement path 12 is possible than the vertical direction. As also shown in FIG. 4, the bending edge 8 can also be formed by a bending tool 37 fixed replaceably onto the bending bar 7. Furthermore, the bending edge 8 can be adjusted in length for the required bending task by arranging such bending tools 37 in a row.

In FIG. 4 it is also shown by dashed lines that underneath the first bending bar 7 an additional bending bar 38 with an additional bending edge 39 can be provided by means of which a workpiece 1 can also be angled upwards. A view of the bending bar guide and the bending bar drive is omitted for a better overview at this point.

In order to perform the bending method already described with reference to FIGS. 1 and 2, the clamping beams 27 and 28 supporting the clamping jaws 2, 3 are mounted adjustably by means of a transverse guide 40 and an adjusting drive 41 relative to the machine frame 19 in horizontal direction. By means of this adjustability a portion of the workpiece 1 angled by means of the bending bar 7 or the bending edge 8 can be angled over a shaping angle of more than 90°.

The adjusting drive 41 is supported on the one hand on the machine frame 19 and on the other hand on the O-frame 31 which is connected to the lower clamping beam 27 and via the clamping beam guide 29 to the upper clamping beam 28. The O-frame 31 is guided on its lower side and its upper side over the transverse guide 40 on the machine frame 19, whereby a linear guide is provided as the transverse guide 40 in the shown embodiment. An alternative to this embodiment would also be a transverse guide 40 by means of bearing eccentrically on the machine frame 19, whereby a circular arc-shaped adjustment path, already shown in FIG. 2 for moving the clamping jaws 2, 3 close to the movement path of the bending edge 8 is possible.

The adjusting drive 41 is formed in the shown embodiment by two hydraulic cylinders 42, which perform synchronized movements and thereby ensure an even horizontal adjustment. In this embodiment of a bending press 18 it is an advantage that the lower clamping jaw 2 during the shaping process has no vertical movement component and thereby also a clamped workpiece 1 only has to be moved in horizontal direction. A vertical adjustment of a support device 25 is not necessary in this case.

FIG. 4 also shows that the clamping jaws 2, 3 can be composed of clamping tools 43 secured onto the clamping beam 27, 28.

Figure 5:
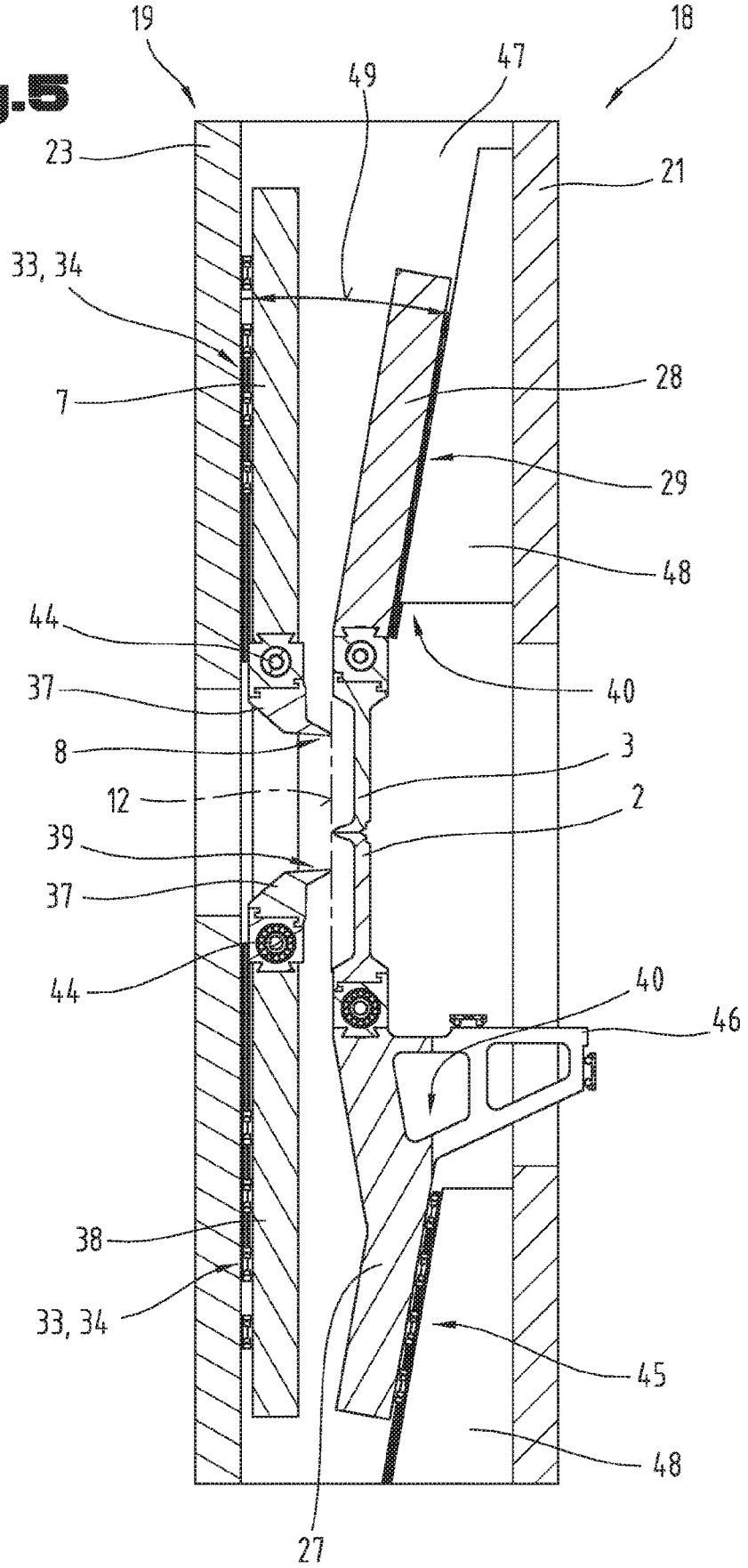
FIG. 5 shows a cross-sectional view of a further possible embodiment of a bending press.

FIG. 5 shows a further and possibly independent embodiment of a bending press 18, wherein the same reference numerals and component names have been used as in the preceding FIGS. 1 to 4.

In the embodiment shown in FIG. 5 the machine frame 19 comprises two spaced apart O-frames 21 and 23, between which cooperating clamping beams 27 and 28 and the alternatively used bending bars 7 and 38 are mounted adjustably.

The bending bars 7, 38 support, as already described with reference to FIG. 4, bending tools 37, with which a bending edge 8 or 39 is formed adapted to the respective bending task. The bending tools 37 can be guided adjustably, for example by means of movement spindles 44, automatically along the bending bars 7, 38.

The bending bars 7 and 38 are mounted adjustably by means of linear guides 34 on the inside of the O-frame 23 and are also drive-connected by means of not-shown bending bar drives 35, for example in the form of hydraulic cylinders or spindle drives by electric motor.

The clamping beams 27 and 28 supporting the clamping jaws 2, 3 are mounted on the inside of the additional O-frame 21, wherein the clamping beam guide 29 of the upper clamping beam 28 is arranged obliquely relative to the bending bar guide 33 in the form of the linear guide 34.

The obliquely arranged clamping beam guide 29 is in this embodiment a component of the transverse guide 40, which also comprises a clamping beam guide 45 of the lower clamping beam 27. The latter is aligned to be parallel to the clamping beam guide 29 of the upper clamping beam 28, for which reason the clamping beams 2 and 3 clamping a workpiece 1 can be adjusted precisely synchronously with one another. For this purpose clamping beam drives are provided, not shown in FIG. 5, which comprise for example hydraulic cylinders or spindle drives with electric motors. The adjusting drive 41 for the clamping beams 27 and 28 is formed in this embodiment by the two synchronized bar frame drives. Alternatively, it is also possible to lock the two clamping beams 27 and 28 mechanically with a workpiece 1 clamped in between and to adjust both clamping beams 27, 28 by means of only one clamping beam drive, whereby also an adjusting drive 41 can be formed for the transverse movement of the clamping beam 27 and 28 relative to the bending bar movement. As also shown in FIG. 5 on the bottom clamping beam 27 a support element 46 can be provided which forms part of a support device 25 for a workpiece 1. The two O-frames 21 and 23 are connected to one another by side stands 47 or other transverse connectors, whereby the flow of force is established between the two O-frames 21 and 23.

The oblique position of the clamping beam guides 29 and 45 can be produced for example by wedge-shaped spacers 48, onto which bearing rails can be secured for the linear guides of the clamping beam guides 29, 45. An inclination angle 49 between the linear guide 34 of the bending bar 7, 38 and the clamping beam guides 29, 45 is in particular between 10° and 30°.

Figure 6:
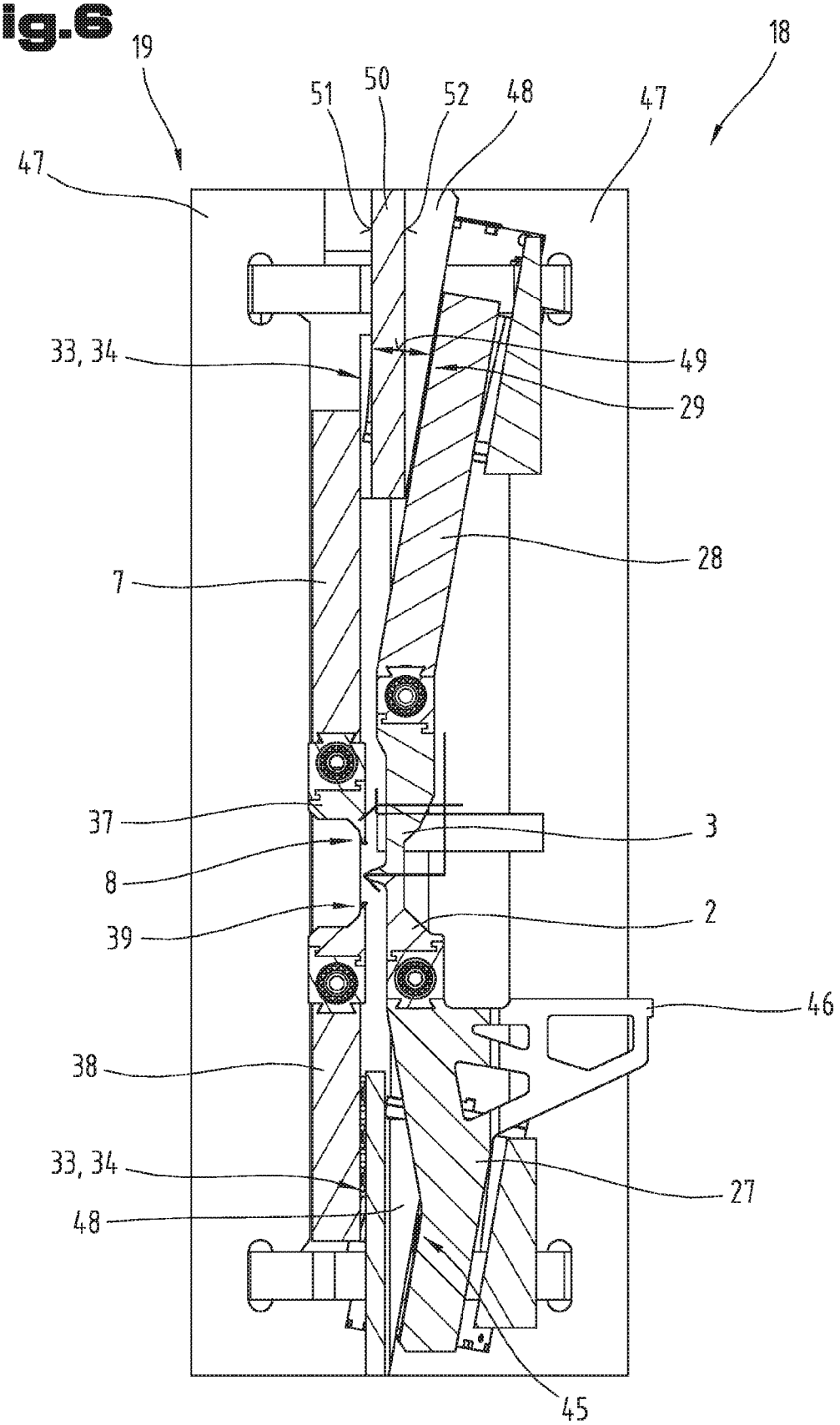
FIG. 6 shows a cross-sectional view of a further possible embodiment of a bending press.

FIG. 6 shows a further and possibly independent embodiment of the bending press 18, wherein the same reference numerals and component names have been used for the same parts as in the preceding FIGS. 1 to 5. To avoid unnecessary repetition reference is made to the detailed description of the preceding FIGS. 1 to 5.

The embodiment according to FIG. 6 has a similar kinematics for the bar frame movement as the embodiment according to FIG. 5, but unlike FIG. 5 a central, plate-like frame part 50 is provided on the opposite outsides 51 and 52 of which the bending bar guides 33, 34 or the clamping beam guides 29 and 45 are arranged. The flow of force from the shaping edges to the bending edge is performed in this embodiment directly via the central frame part 50 and in this embodiment the side stands 47 can be dimensioned to be weaker owing to the smaller load. In this embodiment the central frame part 50 is designed for example as an O-frame and this results in a very large bending clearance both in front of and behind the bending tools.

In the described embodiments it is also possible that two spaced apart and opposite oriented bending bars 7, 38 are arranged on a common bar frame, in particular an O-frame, and the latter can be adjusted linearly by means of the bending bar guide 33 in the form of the linear guide 34.

Finally, as a point of formality, it should be noted that for a better understanding of the structure of the bending press

18, the latter and its components have not been represented true to scale in part and/or have been enlarged and/or reduced in size.

The exemplary embodiments show possible embodiment variants of the bending press 18, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, individual features or combinations of features from the shown and described different example embodiments can in themselves represent independent solutions according to the invention.

The problem addressed by the independent solutions according to the invention can be taken from the description.

Lastly, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1, 2; 3; 4; 5; 6 can form the subject matter of independent solutions according to the invention. The objectives and solutions according to the invention relating thereto can be taken from the detailed descriptions of these figures.

LIST OF REFERENCE NUMERALS

1 workpiece
2 clamping jaw
3 clamping jaw
4 portion
5 shaping edge
6 shaping edge
7 bending bar
8 bending edge
9 workpiece plane
10 distance
11 workpiece thickness
12 movement path
13 adjustment path
14 adjustment path
15 clamping movement
16 movement path
17 adjustment path
18 bending press
19 machine frame
20 front side
21 O-frame
22 rear side
23 O-frame
24 through opening
25 support device
26 clamping device
27 clamping beam
28 clamping beam
29 clamping beam guide
30 clamping beam drive
31 O-frame
32 hydraulic cylinder
33 bending bar guide
34 linear guide
35 bending bar drive
36 hydraulic cylinder
37 bending tool
38 bending bar
39 bending edge
40 transverse guide
41 adjusting drive
42 hydraulic cylinder
43 clamping tool
44 spindle
45 clamping beam guide
46 support element
47 side stand
48 spacer
49 inclination angle
50 frame part
51 outside
52 outside

What is claimed is:

1. A method for forming a workpiece comprising the steps:

clamping the workpiece between a first clamping jaw with a first shaping edge and a second clamping jaw with a second shaping edge so that a portion of the workpiece projects between the shaping edges; and guiding afterwards a bending edge of an adjustable bending bar at a distance past the shaping edges, whereby the portion is angled relative to the part of the workpiece clamped between the clamping jaws;

wherein the bending edge of said adjustable bending bar is guided along a straight movement path and wherein after the bending edge has passed the shaping edges, said shaping edges are adjusted along an adjustment path which approaches the movement path of the bending edge.

2. The method as claimed in claim 1, wherein after the bending edge has passed the shaping edges, the movement of the bending edge is substantially or completely stopped and at the same time or immediately after the shaping edges are moved closer at a right angle perpendicular to or perpendicularly over the movement path of the bending edge.

3. The method as claimed in claim 1, wherein once the bending edge has passed the shaping edges, the shaping edges are moved closer at an inclination angle perpendicular to or perpendicularly over the movement path of the bending edge and the movement of the bending edge coupled with the adjusting movement of the shaping edges is continued until the completion of the forming process.

4. The method as claimed in claim 1, wherein the clamping jaws with their shaping edges are guided along a curved adjustment path.

5. The method as claimed in claim 4, wherein the curved adjustment path is circular.

6. The method as claimed in claim 1, wherein the bending edge of said adjustable bending bar is guided along the straight movement path in a vertical oriented direction.

7. The method as claimed in claim 1, wherein the bending edge of said adjustable bending bar is guided along the straight movement path in an orientation different from the vertical orientation.

8. The method as claimed in claim 1, wherein the shaping edges of the clamping jaws are adjusted along the adjustment path at a right angle with respect to the straight movement path of the bending edge of said adjustable bending bar.

9. The method as claimed in claim 1, wherein the shaping edges of the clamping jaws together with the clamped workpiece are adjusted along the adjustment path.

10. The method as claimed in claim 1, wherein the distance in a horizontal direction between clamping beams supporting the clamping jaws and the bending bars can be adjusted.

11. The method as claimed in claim 10, wherein the clamping beams supporting the clamping jaws are each adjusted along a straight adjustment path and the straight adjustment path of each of the clamping beams supporting the clamping jaws run parallel to one another.

12. The method as claimed in claim 11, wherein said adjustment paths of the clamping beams supporting the clamping jaws run at an inclination angle relative to the straight movement path of the bending edge.

* * * * *